United States Patent [19]

Pongrass et al.

[11] Patent Number: 4,598,529

[45] Date of Patent: Jul. 8, 1986

[54] METHOD AND APPARATUS FOR FORMING, FILLING AND SEALING FLEXIBLE PLASTIC BAGS

[76] Inventors: Robert G. Pongrass, 122 Ocean Street, Woolhara 2025 New South Wales, Australia; Christopher C. Rutter, 21063 Cabot Blvd., Hayward, Calif. 94545

[21] Appl. No.: 692,539

[22] Filed: Jan. 18, 1985

[51] Int. Cl.[4] ..... B65B 3/02

[52] U.S. Cl. ..... 53/452; 53/384; 53/468; 53/570

[58] Field of Search ..... 53/51, 451, 452, 468, 53/558, 574, 384, 459, 570

[56] References Cited

U.S. PATENT DOCUMENTS

| | | | |
|---|---|---|---|
| 1,986,611 | 1/1935 | Thomsen | 53/51 X |
| 2,612,738 | 10/1952 | Salfisberg | 53/558 X |
| 3,044,229 | 7/1962 | Stroop | 53/451 |
| 3,372,797 | 3/1968 | Grevich | 53/451 |
| 4,110,956 | 9/1978 | Weisberg | 53/558 |
| 4,354,337 | 10/1982 | Mori et al. | 53/558 X |

FOREIGN PATENT DOCUMENTS

| | | | |
|---|---|---|---|
| 550114 | 10/1956 | Belgium | 53/51 |

*Primary Examiner*—John Sipos
*Assistant Examiner*—Steven P. Weihrouch
*Attorney, Agent, or Firm*—Linval B. Castle

[57] ABSTRACT

A web of plastic bags is made from rollstock of a strong heat sealable plastic material for the bulk storage and dispensing of liquids by passing two aseptic sheets of the material into a press that heat bonds the longitudinal edges and laterally across the sheets to form a web of sealed bags. The longitudinally bonded strips are perforated to engage sprocket wheels which draw the web of bags to a position at which a dispensing fitment is bonded to the outer surface of one sheet, and then to a station which cuts a short lateral slit across only one sheet. The web then passes over and hangs from the sprocket so that the slit slightly opens to permit filling of the bag from the bottom up with a long pointed diving fill tube that isolates the bag contents from the slit. The area around the slit is then heat sealed against the opposite side of the bag to prevent leakage of the bag contents and the admission of contaminants into the bag.

7 Claims, 5 Drawing Figures

METHOD AND APPARATUS FOR FORMING, FILLING AND SEALING FLEXIBLE PLASTIC BAGS

BACKGROUND OF THE INVENTION

This invention relates generally to the production of flexible, heat sealable, plastic bags and their subsequent filling and sealing, and in particular to a method and apparatus for forming a continuous web of sealed bags, the filling through a slit opening cut in each bag, and the heat sealing of the slits to reseal the bag for preserving an aseptic bag interior and for protecting the contents from contamination.

Flexible, heat sealable, bags formed with a lamination of Nylon or other strong flexible material, are extensively used in many industries and are particularly valuable for the packaging of fluids or fine granular materials. One important advantage of such packaging is that fluids such as juices, wines or the like are fully sealed against leakage in such a bag and, equally important, against the admission of air, gasses, moisture, or other objects that may damage the bag contents.

Flexible plastic bags for the storage and shipping of fluid products are generally formed with an attached fitment which opens into the bag for filling and eventual dispensing of the product. Often the filled bag is placed in a carton or other rigid container and a dispensing tap attached to an aperture in the carton is connected to the bag fitment for convenient dispensing of the contained product.

Flexible plastic bags or containers of the type described above have heretofore been manufactured by heat sealing the edges and by making lateral separations on two or more webs of thin heat sealable plastic. The sealed lateral bags are often separated by perforations for ease in separating the bags from the web and each bag in the web is provided with an attached open fitment for filling and dispensing, such as shown in U.S. Pat. No. 4,386,636.

If the plastic bags are to be used for comestibles or other products sensitive to contamination, bag sterilization is important. While container manufacturers can easily produce internally aseptic flexible plastic bags, those with attached unsealed fitments can readily become internally contaminated to possibly shorten the life or ruin the product to be contained therein. If internal bag contamination is an important consideration, the bag manufacturer can supply the bag webs with capped fitments. However, internally pre-sterilized bags with capped fitments must be sterlized externally around the cap and filling fitment in an aseptic chamber just prior to removal of the cap and the filling of the bag to ensure against contamination during filling in the filling chamber, and then replaced immediately after filling in an attempt to avoid damage or contamination of the product therein.

The flexible plastic bags made in accordance with the present invention are formed and then filled and sealed without use of such a filling fitment. By thus eliminating the filling fitment, exterior sterilization of a bag prior to filling is a simple and uncomplicated process in a sterilized chamber.

In the method and apparatus described herein, an internally presterilized plastic tube may be employed or, in a preferred embodiment, two identical webs of flexible, heat sealable plastic material may be sterilized before or after their joining in a conveyor where the combined webs are heat sealed along the edges to form a tube. The tube thus formed is then heat sealed across the bag separation positions, punched along the edges so that the web can be drawn through the conveyor system by rotating sprocket wheels, and laterally perforated along the heat sealed bag separations. If desired, the web of bags thus formed may be removed from the conveyor and folded in a storage container for future use; or if desired, the web may continue along the conveyer to receive an optional dispensing fitment, such as that disclosed in our copending U.S. patent application Ser. No. 447,493, filed Dec. 6, 1982. The fitment is heat sealed to the exterior surface of each bag, and its attachment is followed by the cutting of a lateral filling slit through only one sheet of the plastic, the admission of the product through a nozzle introduced through the slit, and the heat sealing of the lateral filling slit to thereby seal the bag from leakage of the product and the admission of air or external contaminants. It is important to note that internal sterilization is preserved both in bags fabricated from individual plastic webs and in bags fabricated from presterilized plastic tubes, and the subsequent addition of an optional dispensing fitment to their exterior surfaces cannot affect their aseptic interiors. Further, the bags do not become contaminated between the period of time from the lateral filling cut to the actual filling through the nozzle and the resealing of the filling cut immediately following the withdrawal of the nozzle if these operations are conducted in a sterile chamber.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
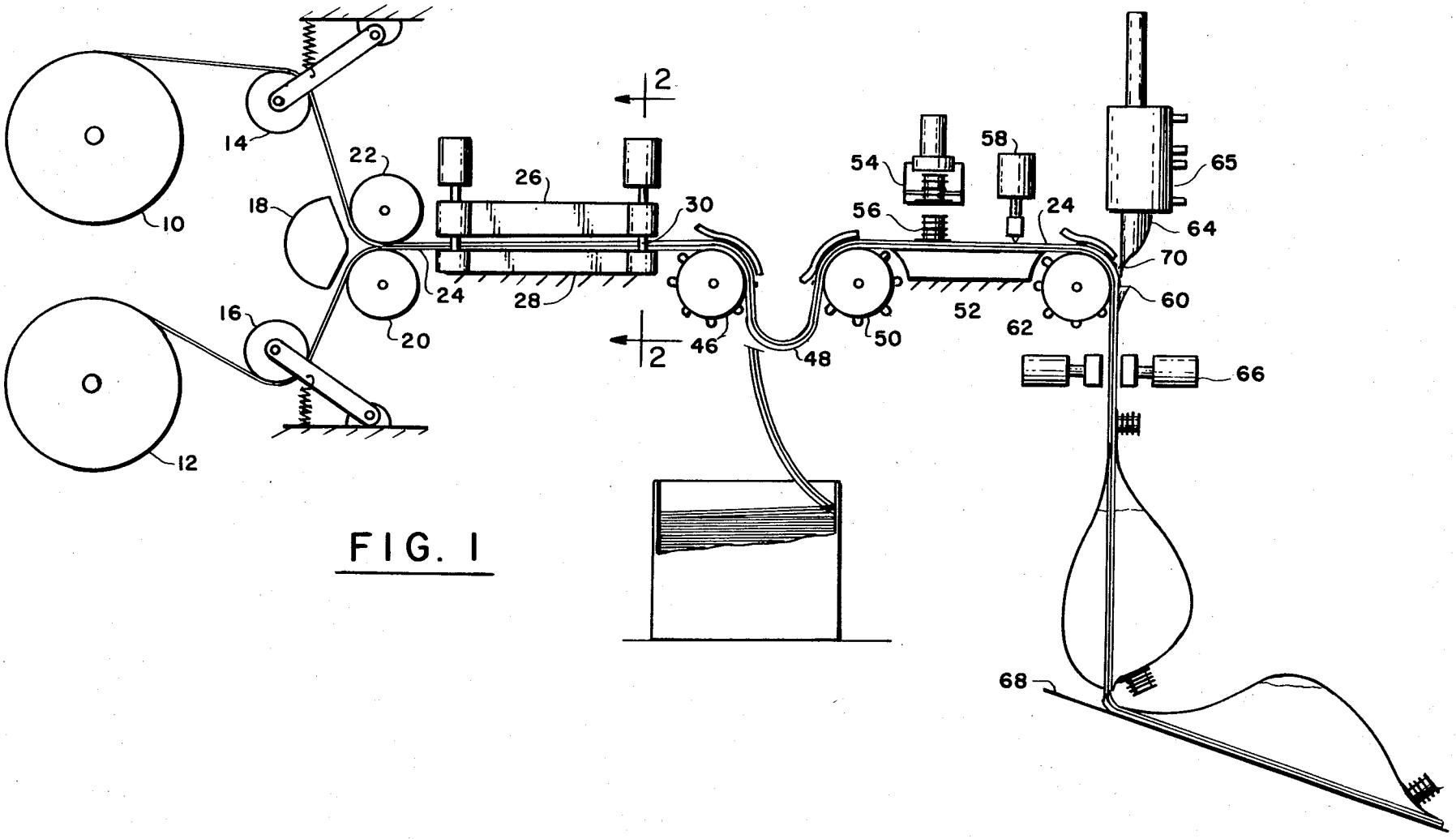
FIG. 1 is a schematic drawing illustrating the various components in the forming and subsequent filling and sealing of flexible heat sealable plastic bags.

FIG. 1 schematically illustrates the apparatus for forming flexible plastic fluid containers and for filling and sealing them against loss of the contents and against the admission of air or external contaminants. As illustrated in this figure, rolls 10, 12 contain supplies of a flexible plastic, the plastic in each roll preferably being a three layer material formed of a center layer of a strong flexible material such as Nylon that laminated to outer layers of a heat sealable material such as polyethylene. The plastic from each roll passes over spring biased web tensioning rollers 14, 16 and the surfaces hereinafter defined as the inner surfaces may be sterilized by a gamma irradiator 18. If preferred, a roll of presterilized flexible plastic tubing may be used to replace the separate rolls of plastic, and the interior sterilization of either may be preformed before or after formation of the bags.

In the embodiment of FIG. 1 the plastic webs, after passing before the irradiator 18, is pressed together by web straightening rollers 20, 22 which operate to press the two single plastic webs into a smooth combined web 24 prior to its edge and lateral sealing into individual sealed bags. If desired, a wide ribbon of a laminated hygroscopic/non-hygroscopic material such as a polyethelene/Nylon may be inserted between the webs before entering the web strightening rollers. As described and claimed in copending patent application Ser. No. 555,045, filed Nov. 25, 1983, such a ribbon will curl when the hygroscopic layer absorbs a liquid to form a curved semi-rigid strip which will prevent the bag from collapsing as the liquid product is dispensed therefrom. If an optional dispensing fitment is to be heat bonded to the bag outer surface, it is desirable to bond a patch of laminate composed of a high melting material such as Nylon and low melt material such as polyethylene on one side to the interior surface at the location of the fitment so that the heat bonding of the fitment will not also bond together the two sides of the bag.

Figure 2:
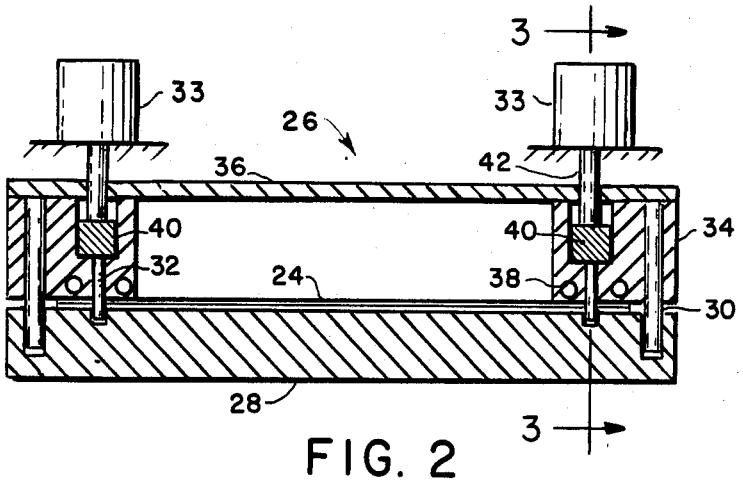
FIG. 2 is a sectional elevation view of the bag forming and perforating press taken along the lines 2—2 of FIG. 1.
Figure 3:
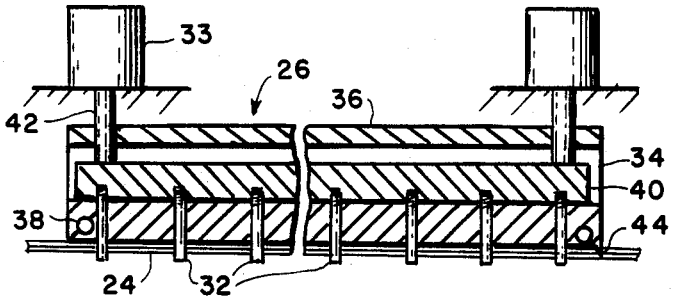
FIG. 3 is a sectional elevation view of the bag forming press taken along the lines 3—3 of FIG. 2.

The smoothed combined web 24 passing through the web straightening rollers 20, 22 is drawn into a sealing and perforating press 26 shown in greater detail in the sectional drawings of FIGS. 2 and 3. The press 26 heat seals while punching a series of equally spaced sprocket holes along both side edges, and preferably simultaneously heat seals and perforates laterally across the web to form a web of completely edge sealed plastic bags which may be separated into individual bags by tearing the lateral perforations.

Referring now to the detailed sectional drawings of FIGS. 2 and 3, the sealing and perforating press 26 includes a solid metal base unit 28 having suitable holes in the top surface for receiving guide rods 30 and the several sprocket hole punches 32 along the edge. The combined web 24 rests upon the top surface of the base unit and is advanced after the web has been heat sealed and punched. Overlying the base unit 28 and vertically moveable by pneumatic actuators 33 is a punching and sealing unit 34. Unit 34 is rectangular in plan with dimensions determined by the desired dimensions of the web 24 and the sealed bags being made therefrom and preferably is formed as a metal frame that is hollow in the center with an overylying cover plate 36 as shown in FIG. 2. The guide rods 30 extend through the frame portion up to the overlying cover plate 36 and holes 38 around the lower surface and parallel thereto carry electrical heating elements that operate to heat seal together the laminates forming the web 24 when the actuators 33 forces down the punching and sealing unit 34 against the web 24 and base unit 28. As will be subsequently discussed, the sealing unit 34 preferably seals arcuate inside corners in the web.

The hollow frame portion of the punching and sealing unit 34 contains a rectangular groove along the longitudinal edges and in the top surface for receiving a punch mounting bar 40 that extends substantially the full length of the frame portion. The vertical dimension of the bar is less than that of the rectangular groove so that the bar, which is attached to the actuator rods 42 of the pneumatic actuators 33, may be moved vertically within the rectangular groove and up to the lower surface of the plate 36 which covers the groove. As best shown in FIG. 3, a plurality of sprocket hole punches 32 are threaded into the lower surface of the bar 40 and extend through holes in the frame member and into clearance holes in the base unit 28 of FIG. 2. Thus, when the pneumatic actuators 33 extent their actuator rods 42, the bars 40 press down on the lower surface of their grooves to force the punching and sealing unit 34 down to both heat seal the edge of the web and punch a line of sprocket holes along that sealed edge. When the actuators 33 start to lift, the bar 40 is first lifted to disengage the attached the punches 32 from the hot web 24 and when the top of the bar contacts the lower surface of the cover plate 36 the entire punching and sealing unit 34 is raised to release the sealed and perforated web.

Figure 4:
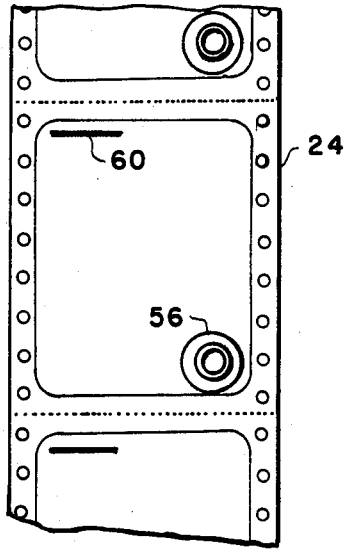
FIG. 4 is a view of a portion of a plastic bag web illustrating attached fitments and lateral filling cut through one surface thereof.

As shown in FIG. 3 the leading end of the punching and sealing unit 34 contains the lower edge holes 38 for a heating element that laterally seals across the web to form sealed bags. Attached to or formed in the lower leading edge of the unit 34 is a saw toothed perforator blade 44 which forms perforations laterally across the sealed web 24 to facilitate the separation of the web into individual bags. As mentioned earlier, it is preferable that the web 24 is sealed with arcuate inside corners so that the sealed and perforated web 24 will appear as shown in FIG. 4. In addition to the important advantage of reducing corner stresses and of providing additional strength to the corners of the finished sealed plastic bag, the sealed curved corners aid in maintaining bag cleanliness by preventing small portions of the bag contents from becoming embedded the corners.

As shown in the schematic drawing of FIG. 1, the perforated, sealed and sprocket hole punched web of plastic bags now passes over a power rotated sprocket wheel 46 that draws the web 24 through the smoothing rollers 20, 22 and through the sealing and perforating press 26 in intermittent rotations that permit the web to remain in the press 26 for the two or three seconds necessary to thoroughly seal the web.

When the web has passed from the sprocket wheel 24 it is a completely sealed, sprocket punched, and laterally perforated strip of interconnected bags that may, if desired, be removed from the apparatus, fan-folded, and boxed for future use, as shown in FIG. 1. In the preferred embodiment, however, the web 24 is looped at 48 and brought over a second sprocket wheel 50 and upon the flat top surface of a base unit 52.

An auxiliary conveyor supplies optional flanged bag-piercing type dispensing fitments to a pneumatically actuated fitment press 54 which is lowered to seal a fitment 56 to the exterior surface of each sealed bag in the web 24. The fitment press 54 is actuated at a correct timing that will attach the fitment to the end of each bag that will be the lower end when the bag has been filled and placed in its permanent shipping and dispensing box.

The web is then advanced into a sterilizable chamber 55 which contains a gamma ray radiator and which also may be further flushed and sterilized by the admission into the chamber of a low pressure aseptic gas which is permitted to escape in the entry and exit areas around the web of bags. Within the chamber 55 is a cutter 58 which is carefully adjusted to cut either a lateral arcuate or straight slit 60 of about three inches in length through only one side of the bag web at a location in each bag at the end opposite to the location of the fitment, as shown in FIG. 4. Single layer cutters such as the cutter 58 are in common use in, for example, the cutting of adhesive paper labels attached to a backing sheet. The cutting of the slit 60 in only one of the two sides will open the bag but because it is within the sterilizing chamber 55, the bag is not subject to contamination.

After each bag has received its slit 60, the sprocket holes in the web pass over another sprocket wheel 62 operating in conjunction with the wheel 50. The web 24 is lowered from the wheel 62 so that it hangs from its sprocket holes and, in thus turning downward, the slit 60 slightly opens as shown in FIG. 1. While the opening may be somewhat small, it is adequate to permit the entrance of a pointed diving nozzle 64 which may fill the bag from the bottom up, as will be subsequently described. After the bag has been filled, the sprocket wheel 62 immediately advances the open slit to a sealing press 66 which comprises heated elements that are pressed together from both front and rear of the bag in the area surrounding the slit to heat seal together the two plastic laminates forming the bag. The filled and sealed bag is then passed from the sterilizing chamber 55 to an output conveyer 68 and from the apparatus of the invention.

Figure 5:
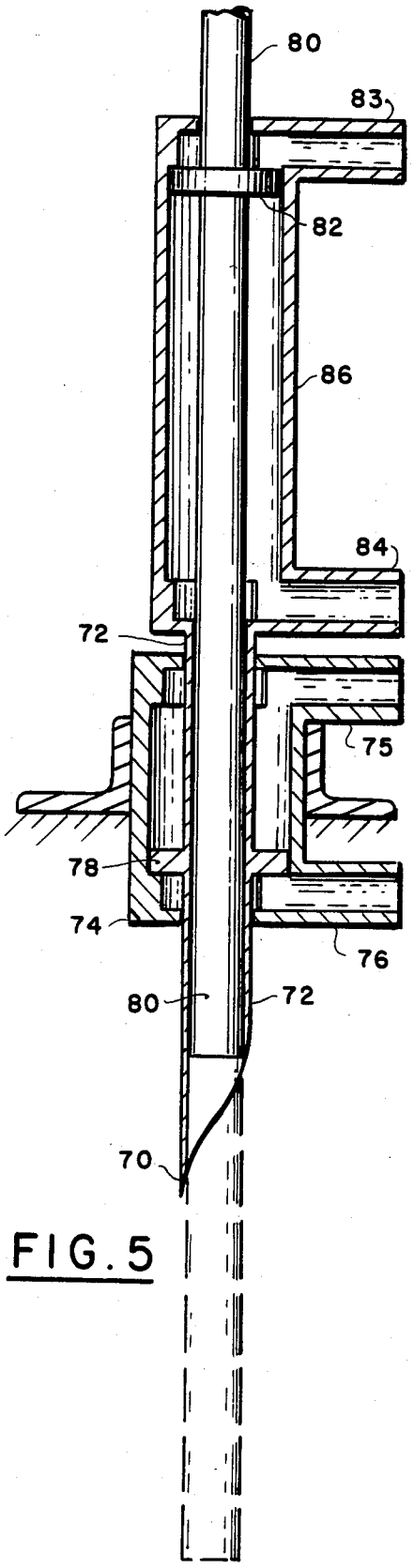
FIG. 5 is a sectional view of a diving filling nozzle.

The preferred embodiment of the diving nozzle 64 is illustrated in detail in FIG. 5 and includes within a housing (not shown) a pointed pen shaped nozzle tip 70 that is positioned in close proximity and substantially tangent with the surface of the web as it is bent over the sprocket wheel 62 of FIG. 1. The tip 70 is longitudinally moveable along the tangent and is positioned to enter the small opening in the bag that is provided by the slit 60. As shown in FIG. 5, the tip 70 is at the end of a tube 72 which extends into and from the opposite end of a stationary cylinder 74 having pneumatic openings 75, 76 at each end thereof. The tube 72 has an external coaxial piston 78 within the cylinder 74 so that the tube will longitudinally travel in accordance with the application of pressure into one of the openings 75 or 76. As shown in FIG. 5 the tube 72 is extended from the cylinder 74 as if pressure had been applied to the opening 75.

When the tip has entered the slit 60 in a bag the bag opening is enlarged by the extension of the tube further into the bag. At this point a filling tube 80 within the tube 72 and coaxial therewith is extended from the tip and deep into the bag and near its bottom so that the surface of the contents cannot bubble or form a "head" and, even more important, to keep the contents clear of the slit so that the subsequent application of heat to seal the opening will not burn or scorch any heat sensitive contents or permit it to adhere to the surface of the heat sealing press 66.

The coaxial filling tube 80 extends through the length of an elongated cylinder 86 that is attached to the interior end of the diving nozzle tube 72 and therby moves longitudinally with the movement of the tube 72 and its tip 70. The filling tube 80 has a external coaxial piston 82 which, upon the application of pressure to either of the openings 83, 84 in the cylinder 86 drives the filling tube the length of its moveable cylinder and thus the filling tube reaches deep into the bag to be filled. The filling tube 80 extends out from the top end of the cylinder 86 and is attached to a source of the product that is to fill the bags in the web.

It will be noted that the contents of a filled and sealed bag are protected against leakage from the bag and also against the admission of air or contaminates. This greatly extends the shelf life of bulk packages juices, wines, and grandular products that may be packaged in flexible plastic bags for future dispensing by piercing the bag surface within the tubular fitment by a suitable dispensing tap attached thereto. It should also be noted that the steps of edge sealing, cross-sealing, cross-perforating, and sprocket hole forming may, is desired, be performed by separate steps or a combination thereof, and that the attachment of a dispensing fitment to the bag surfaces is an optional step that may be eliminated, if desired. Therefore, the invention herein is to be limited only by the appended claims.

What we claim is:

1. A method for forming a web of series connected, flexible container bags from two elongated sheets of heat sealable plastic material, and for filling and sealing said bags, said method comprising the steps of:

placing the first surface of a first one of said elongated sheets against a corresponding first surface of a second one of said sheets;

heat bonding together said first and second sheets in a longitudinal strip along the edges of the joined elongated sheets to form a tubular web;

heat bonding said first and second sheets in lateral strips across said tubular web in a pattern defining a container bag, and forming a line of lateral perforations through said lateral strips for separating bags from said tubular web;

forming a line of sprocket holes along each heat bonded longitudinal strip of said tubular web, said sprocket holes being engagable with the sprockets on a rotatable sprocket wheel;

advancing said web, the first end of each bag leading the second end thereof, to a slitting station where a lateral slit is cut through a portion of the first plastic sheet of each container bag in said web at a location adjacent the second end of the bag;

passing the longitudinal sprocket holes in said web of bags over and around a sprocket wheel to bend said web to a position at which the lateral slit will cause the first plastic sheet to separate from said second plastic sheet to form an opening into the interior of a bag;

filling said sprocket wheel suspended bag through said opening; and heat sealing together the first and second plastic sheets in the area of said opening.

2. The method claimed in claim 1 including the additional step, following the step of forming a line of sprocket holes, of:

drawing said web to a fitment attachment location, and bonding a dispensing fitment to an exterior surface of each individually defined bag in said web at a location adjacent the first end of said bag.

3. A method for forming a web of series connected flexible container bags from an elongated tube of heat sealable plastic material having first and second sides, and for filling and sealing said bags, said method comprising the steps of:

heat bonding together a longitudinal strip along the edges of the first and second sides of said elongated tube;

heat bonding together said first and second sides in lateral strips across the plastic tube in a pattern defining a container bag;

forming a line of sprocket holes along each heat bonded longitudinal strip, said sprocket holes being engagable with a rotatable sprocket wheel;

advancing the web of bags to a slitting station and cutting a lateral slit through the first side of each container bag at a location corresponding to the lagging end of each bag in said advancing web;

hanging said web of bags by its sprocket holes over a sprocket wheel and passing said web around the wheel so that the lateral slit is located in a position that will cause the first side of each bag to separate from the second side and thereby open said slit;

filling each bag in said web through the opened lateral slit; and heat sealing together the first and second sides of each bag at said slit.

4. Apparatus for forming a continuous web of plastic bags from at least two supply sources of heat sealable plastic material, for filling said bags with a product, and for sealing the filled bags, said apparatus including:

a sealing press having a substantially planar surface formed with longitudinal and lateral heatable strips defining the shape of the plastic bags;

a base unit having a substantially planar surface positioned adjacent and substantially parallel to the planar surface on said press;

power means for moving the surfaces of said press and said base unit toward and from each other;

a perforation cutter extending from at least one lateral end of said sealing press surface;

a plurality of sprocket hole punches equally spaced substantially along the center of each longitudinal heatable strip;

a power rotated sprocket wheel having sprockets for engaging sprocket holes produced by sprocket hole punches and for drawing the flexible plastic material from the respective supply sources into position between said press surface and said base unit surface;

means for bonding a dispensing fitment to an exterior surface adjacent a first end of each bag defined by the longitudinal and lateral heat bonded strips in said web;

cutting means for cutting a lateral slit across a portion of the first plastic sheet of each bag at a location adjacent the second end of said bag;

sprocket means for engaging the sprocket holes in said web and for bending said web so that the lateral slit in the first plastic sheet of each bag will separate from the second sheet to form an opening into the interior of each bag;

filling means for entering said opening and for filling each bag; and sealing means for heat sealing together the first and second sheets of each bag at the location of said opening.

5. Apparatus for opening, filling and sealing presealed, flexible, heat sealable, plastic bags formed in a continuous web of bags, said web of bags including a longitudinal strip along each edge of said web, said strip having sprocket holes thereon, said apparatus comprising:

cutting means for cutting a lateral slit across a portion of one sheet of plastic in each bag at a location to be the top end of a filled bag in the web;

means for bending said web in a direction away from said lateral slit and for suspending said bag with said lagging end above the leading end thereof and at a point at which said laterally located slit will separate from the corresponding interior surface of the opposite unslitted plastic sheet of the bag to form an opening into said bag;

said means for bending including a pair of spaced sprocket wheels for engaging the sprocket holes in said strip and around which said strip passes for bending said strip and for suspending said web at a point at which said lateral slit will open to form an opening into said bag;

filling means having a pointed end positioned to enter said opening formed by said slit; and heat sealing means positioned adjacent each surface of said bag, said heat sealing means being positionable against said surfaces over said slit for heat bonding together the plastic sheets of said bag to thereby reseal the bag.

6. The apparatus claimed in claim 5 wherein said filling means comprises a first tube having a pointed end for entering said opening, said first tube being movable along an axis substantially parallel with said bag, said filling means further including a second tube within said first tube and coaxially moveable therein, the end of said second tube being extendable from the pointed end of said first tube to a position near the lower end of said bag, said second tube being attachable to a source of product that will fill said bag from the lower end thereof.

7. The apparatus claimed in claim 5 wherein said web of bags includes a longitudinal strip along each edge of said web, said strip having sprocket holes thereon, and wherein said means includes a pair of spaced sprocket wheels for engaging the sprocket holes in said strip and for suspending said web at a point at which said lateral slit will open to form an opening into said bag.

* * * * *